US006874545B1

(12) United States Patent
Larimer et al.

(10) Patent No.: US 6,874,545 B1
(45) Date of Patent: Apr. 5, 2005

(54) WINE SAVER MACHINE AND STOPPER

(75) Inventors: Robert Larimer, New York, NY (US); Edward Kilduff, New York, NY (US)

(73) Assignee: Metrokane, Inc., New York, NY (US)

( * ) Notice: Subject to any disclaimer, the term of this patent is extended or adjusted under 35 U.S.C. 154(b) by 63 days.

(21) Appl. No.: 10/428,091

(22) Filed: May 2, 2003

(51) Int. Cl.[7] ..... B65B 1/04
(52) U.S. Cl. ..... 141/65; 141/98; 215/228; 220/212
(58) Field of Search ..... 141/65–67, 98, 141/59; 215/228, 296; 220/212

(56) References Cited

U.S. PATENT DOCUMENTS 624,384 A * 5/1899 Schroeder ..... 215/296
1,641,501 A * 9/1927 Lyon et al. ..... 417/490
3,313,444 A * 4/1967 Katell ..... 220/203.07
4,768,665 A * 9/1988 Ballas ..... 215/228
4,911,314 A * 3/1990 Schneider ..... 215/228
5,535,900 A * 7/1996 Huang ..... 215/228
5,564,480 A * 10/1996 Chen ..... 141/65

* cited by examiner

*Primary Examiner*—Steven O. Douglas
(74) *Attorney, Agent, or Firm*—Millen, White, Zelano & Branigan, P.C.

(57) ABSTRACT

A machine includes a body, a hollow cylinder fixedly attached to the body, a piston assembly slidable within the hollow cylinder, and a lever handle pivotally attached to the body. The hollow cylinder has a sealing end, and the sealing end is capable of engaging with and sealing to a stopper. The piston assembly includes a cross wall at a first end. The lever handle is coupled to the piston assembly so as to be capable of sliding the piston assembly in the hollow cylinder.

14 Claims, 11 Drawing Sheets

WINE SAVER MACHINE AND STOPPER

BACKGROUND OF THE INVENTION

1. Field of the Invention

The present invention relates to a pump and bottle stopper. In particular, the invention relates to a pump used to evacuate gas, including air, through the stopper from a partially full wine bottle to better preserve the remaining wine.

2. Description of Related Art

Wine enthusiasts generally allow a newly uncorked bottle of red wine to "breath" for a half an hour or so. Exposing the wine to air for this short time is said to improve the wine. However, exposure of the wine to air for longer periods, such as 6 hours or more, tends to deteriorate the wine. Therefore, if a bottle of wine remains unconsumed, it is preferable to stopper the bottle and then remove air from the partially filled stoppered bottle of wine.

U.S. Pat. No. 4,763,803 to Schneider describes a stopper having a slit valve. The stopper is provided for a bottle which is adapted to be used with a pump for evacuating air from the bottle to preserve wine being consumed from the bottle. The stopper and valve are integral and are made of the same elastic material. The valve is surrounded by a raised circular edge for protecting the slit valve. A circular flange is provided which rests on the top of the bottle neck. The raised circular edge is shaped to sealably receive a pump housing.

U.S. Pat. No. 4,998,633 to Schneider describes a stopper with a valve for a bottle. The stopper and valve are integral and of the same elastic material, the valve being surrounded by a circular raised edge and a circular flange for sealable cooperation with a pump made from plastic material.

U.S. Pat. No. 4,911,314 to Schneider describes a hand operated pump for use with an elastic stopper inserted in the neck of a bottle for varying the internal pressure in the bottle. The pump includes a hollow cylindrical housing, a piston having a piston rod, and a handle. The hollow cylindrical housing has first and second ends. The piston rod is in the form of a hollow pipe with first and second ends. The piston rod has a diameter slightly smaller than the internal diameter of the cylindrical housing. The piston rod has attached to it a cross wall closing the second end of the piston rod thereby forming the piston on the piston rod. The handle is mounted on said first end of said piston rod. The piston further includes a means for slideably and captivatingly mounting the piston in the cylindrical housing with the piston rod being extendable only for a predetermined distance from the first end of the cylindrical housing. The piston rod has a predetermined downward movement in the cylinder. The pump further includes an annular downardly extending means on the second end of the cylinder for axially sealingly engaging an annular elastic upwardly extending wall of a stopper.

SUMMARY OF THE INVENTION

Advantageously, a machine includes a body, a hollow cylinder fixedly attached to the body, a piston assembly slidable within the hollow cylinder, and a lever handle pivotally attached to the body. The hollow cylinder has a sealing end, and the sealing end is capable of engaging with and sealing to a stopper. The piston assembly includes a cross wall at a first end. The lever handle is coupled to the piston assembly so as to be capable of sliding the piston assembly in the hollow cylinder.

Advantageously, a stopper assembly includes a valve assembly and a stopper. The valve assembly includes a valve frame having an aperture through the valve frame, a spring, and a valve extending through the spring and through the aperture.

In an alternative embodiment, a method of preserving wine includes inserting a stopper assembly in a neck of a bottle that contains the wine, installing a pump maciine onto the stopper assembly, drawing a gas from the bottle, and expelling the gas in the chamber. The drawing of the gas from the bottle, draws the gas through a valve assembly of the stopper assembly into a chamber between a piston valve of the pump machine and the stopper assembly by producing a vacuum in the chamber. The expelling of the gas in the chamber, expels the gas through the piston valve by closing the valve assembly and reducing a volume of the chamber.

BRIEF DESCRIPTION OF DRAWINGS

The invention will be described in detail in the following description of preferred embodiments with reference to the following figures wherein.

DETAILED DESCRIPTION OF PREFERRED EMBODIMENTS

Figure 1:
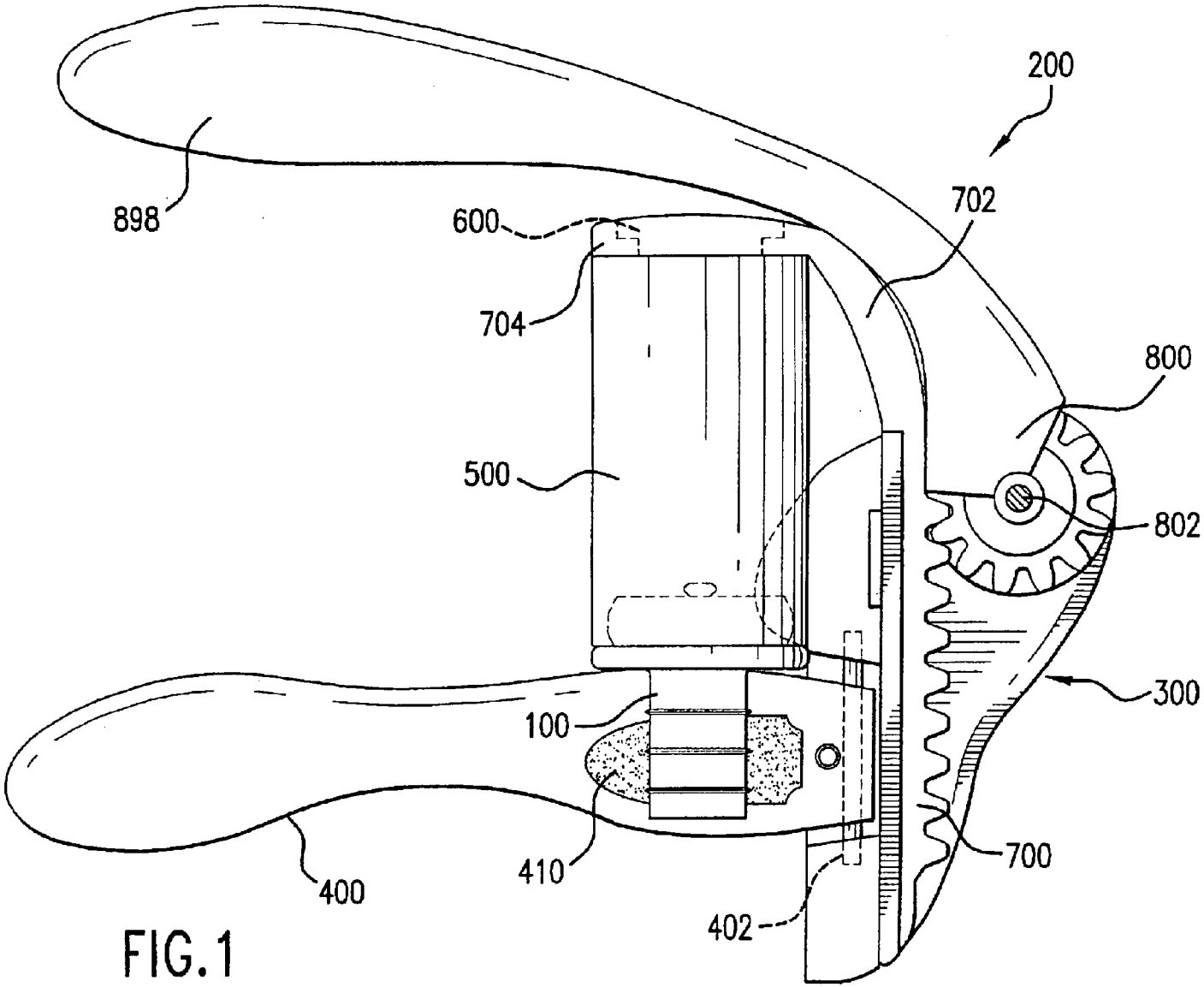
FIG. 1 is a cut away side view of a wine saver machine according to the present invention.

FIG. 1 is a cut away side view of wine saver machine 200 mounted to stopper assembly 100. Machine 200 includes piston assembly 600 that fits slidably in cylinder 500. Cylinder 500 need not be of a shape of a circular cylinder. For example, it may be a rectangular cylinder or a cylinder generated from any closed perimeter. Piston assembly 600 is raised and lowered by lift 704 based on movement of rack 700 relative pinion 800. Rack 700 is connected to lift 704 by rack connector 702. Pinion 800 pivots on pinion axle 802 under leverage force from lever handle 898. The rack and pinion is housed in a body formed of a right body half 300 and a left body half 340. Right body half 300 is one-half of the body and mates with left body half 340. In operation, the body is manually held tight to the neck of the wine bottle by right and left grasps 400, 440; however, only right grasp 400 is shown in FIG. 1. Right grasp 400 includes right resilient pad 410 for a good hold on the neck of the wine bottle. Right grasp 400 pivots on right grasp axle 402.

Preferably pinion 800 and rack 700 (also rack connector 702 and lift 704) are formed from a durable material such as a chrome-plated die-case zinc, die-cast aluminum, stainless steel or a durable plastic such as nylon or poly carbonate. Lever handle 898 extends from pinion 800 and includes an extension along the line of the lever handle that is formed of the same material as the material out of which pinion 800 is formed, for example chrome-plated die-cast zinc. In addition, lever handle 898 may include an overlay of other material that forms a decorative outer shell over the underlying structural material; however the overlaying material, for example ABS plastic, should not cover pinion 800 in a way that would interfere with the operation of the rack and pinion operation. Cylinder 500 and piston assembly 600 are preferably formed of a structural plastic, for example, ABS plastic. Right body half 300 and left body half 340 are preferably formed of a structural plastic, for example, ABS plastic. Right and left grasps 400, 440 are preferably formed of a structural plastic, for example, ABS plastic, but right and left resilient pads 410, 450 are preferably formed of a more elastic material, for example, rubber, to better and more safely grasp the neck of a glass wine bottle. Right and left grasp axles 402, 442 and pinion axle 802 are preferably formed of a durable material, for example, stainless steel.

Figure 2:
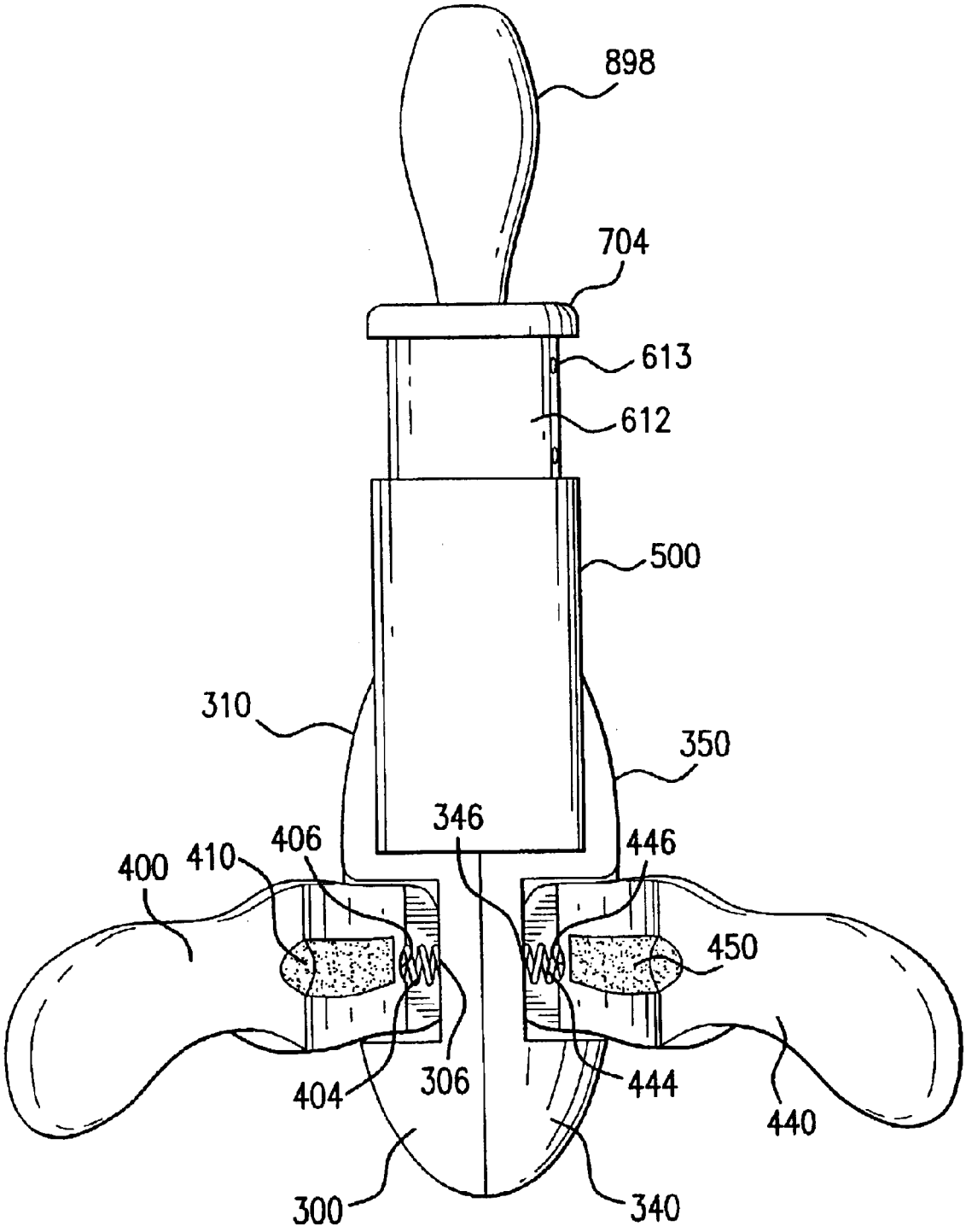
FIG. 2 is rear view of the machine of FIG. 1.

FIG. 2 is rear view of machine 200. Right grasp 400 is urged to an open position by right grasp spring 404. Right grasp spring 404 is disposed between grasp spring receiver 406 formed in the right grasp 400 and body spring receiver 306 formed in the right body half 300 to urge grasp spring receiver 406 apart from body spring receiver 306. Symmetrically, left grasp 440 is urged to an open position by left grasp spring 444. Left grasp spring 444 is disposed between grasp spring receiver 446 formed in the left grasp 440 and body spring receiver 346 formed in the left body half 340 to urge grasp spring receiver 446 apart from body spring receiver 346. Right and left grasps 400, 440 include right and left resilient pads 410, 450. As shown in FIG. 2, the body includes right body half 300 and left body half 340. Right body half 300 includes right body ear 310. Left body half 340 includes left body ear 350. Right and left body ears 310, 350 enclose, or at least partially enclosed, cylinder 500. Cylinder 500 is cemented to the body at right and left body ears 310, 350. Right and left grasp springs 404, 444 are preferably formed of a resilient material, for example, spring steel, stainless steel, or phosphor bronze. Right and left body ears 310, 350 are integrally formed with the rest of the respective right and left body halves 300, 340 and are formed of the same material.

Piston assembly 600 rides up and down in cylinder 500. Piston assembly 600 includes piston side wall 612 having at least one vent 613 therein. Piston assembly 600 is raised and lowered by lift 704 which is connected rack 700. Pinion lever handle 898 turns the pinion gear to move the rack to cause lift 704 to raise and lower the piston assembly.

Figure 3:
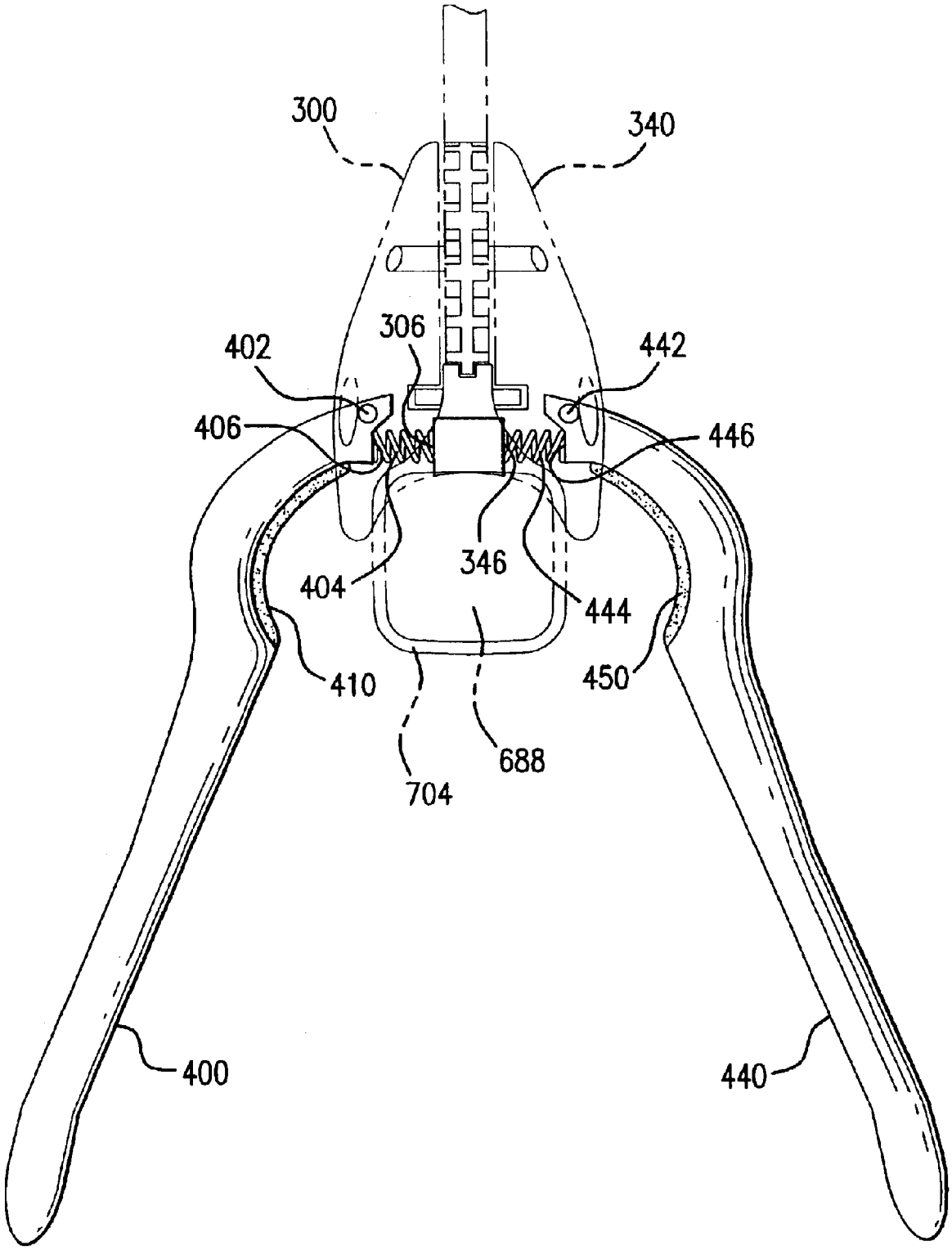
FIG. 3 is a cut away top view of the machine of FIG. 1.

FIG. 3 is a cut away top view of machine 200. Machine 200 includes right grasp 400 pivotally attached to right body half 300 by right grasp axle 402. Right grasp spring 404 urges against grasp spring receiver 406 for the right grasp and against body spring receiver 306 for the right grasp. Symmetrically, left grasp 440 is pivotally attached to left body half 340 by left grasp axle 442. Left grasp spring 444 urges against grasp spring receiver 446 for the left grasp and against body spring receiver 346 for the left grasp. Right and left grasp springs 404, 444 may be any type of repelling spring such as a coil spring, a leaf spring or even a springy material such as rubber. This view shows cover 688 of piston assembly 600 held within lift 704.

Figure 4:
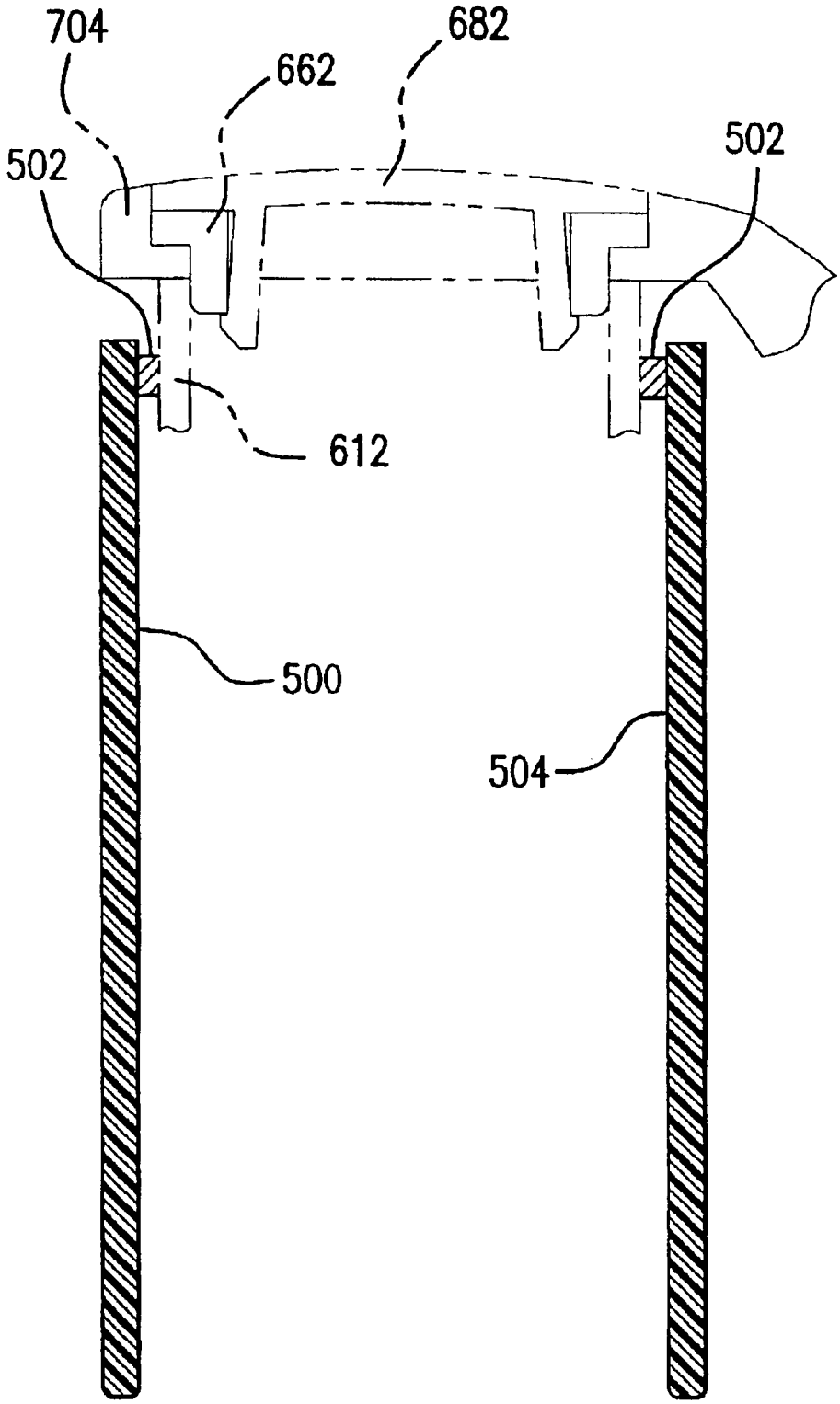
FIG. 4 is a section view of the cylinder of the machine of FIG. 1.

FIG. 4 is a section view of cylinder 500. Cylinder 500 also includes at least three cylinder spacers 502 protruding inwardly toward a central axis of cylinder 500 from, the inner surface of the wall of cylinder 500. Cylinder spacers 502 maintain the piston assembly centered within cylinder 500. Portions of the piston assembly and lift 704; are shown in phantom. Lift 704 is held between piston wall 612 and piston connector flange 662, and the top of the piston assembly is covered with piston cover molding 682.

Figure 5:
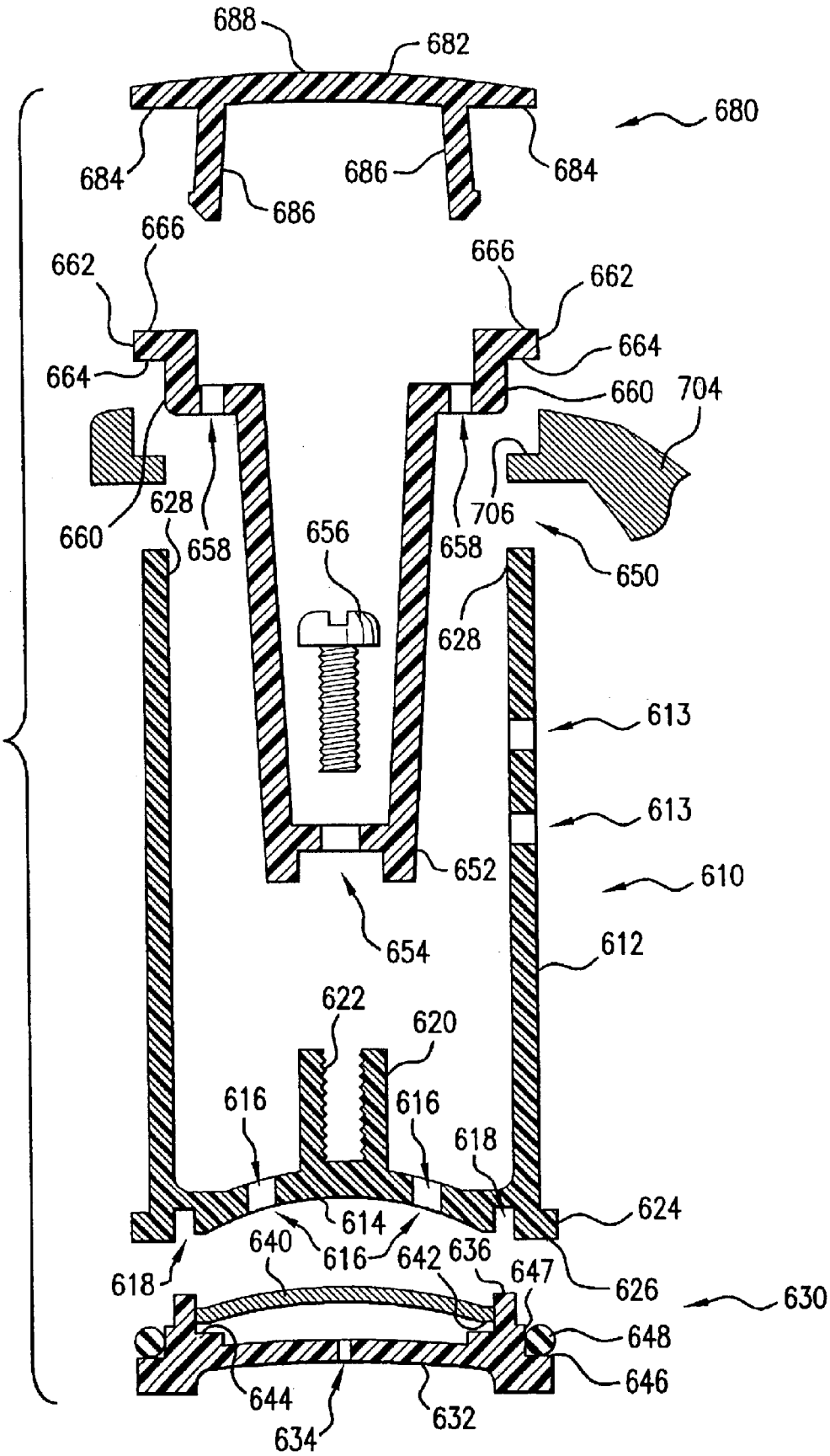
FIG. 5 is an exploded section view of piston assembly of the machine of FIG. 1.

FIG. 5 is an exploded section view of piston assembly 600. Piston assembly 600 includes piston 610, piston valve 630, piston connector 650 and piston cover 680.

Piston 610 includes piston side wall 612 with at least one vent 613 therethrough and piston cross wall 614. Piston side wall 612 has an upper outer surface 628 that confronts, and preferably is cemented to, piston connector outer surface wall 660. At least one aperture 616 is formed through piston cross wall 614. A recess 618 is formed in piston cross wall 614 around its parameter. Boss 620 is formed on an inside surface of piston cross wall 614. Boss 620 includes a bore 622 into which a screw may be inserted. Alternatively, bore 622 may be threaded to function as a nut into which a bolt may be inserted. Piston cross wall 614 includes piston flange 624 extended outwardly from a central axis of the piston assembly and extending around a parameter of the piston. Piston cross wall 614 also includes a lower surface 626 of the piston flange.

Piston valve 630 includes piston valve molding 632 having aperture 634 located therein, for example, centrally. Piston valve molding 632 also includes ridge '636 configured to be cemented into recess 618 of the piston cross wall 614. Piston valve molding 632 also includes upper surface 646 of piston valve and side surface 647 of piston valve. When ridge 636 is cemented into recess 618, piston ring 648 is confined between upper surface 646 of the piston valve and lower surface 626 of the piston flange and is confined outwardly of side surface 647 of the piston valve. Piston valve 630 includes flap 640. Flap 640 has a flap flange 642 formed around a perimeter of the flap, and flap flange 642 confronts and advantageous seats upon flap seat 644 of piston valve molding 632. In operation, air or other gases pass through aperture 634 through a gap between flap flange 642 and flap seat 644, through one or more apertures 616 when the piston valve is lowered (i.e., the piston assembly 600 is lowered). When the valve assembly is raised, flap flange 642 and flap seat 644 press into contact with each other to prevent gases from the at least one aperture 616 from traveling through the gap between flap flange 642 and flap seat 644 and from there through aperture 634.

Piston connector 650 is disposed within lift 704 and is fixedly attached to piston 610 by screw or bolt 656. Piston connector 650 is typically formed as piston connector molding 652 having one or more apertures 658 extending therethrough and having an aperture 654 through which screw or bolt 656 is passed in order to become threaded into bore 622 or nut 622. Piston connector molding 652 includes piston connector outer surface wall 660 that confronts, and preferably is cemented to, piston side wall 612 at the upper outer surface 628. Piston connector molding 652 also includes piston connector flange 662 having upper surface 666 of the piston connector flange and lower surface 664 of the piston connector flange. Lower surface 664 of the piston connector flange sits on and is attached to lift upper surface 706 of lift 704.

Piston cover 680 includes rods 686 extending from a lower surface 684 of the piston cover. When piston cover 680 is installed in the piston connector, rods 686 penetrate apertures 658. Preferably, rods 686 are cemented into apertures 658. Piston cover 680 is preferably formed from piston cover molding 682. Piston cover molding 682 has an upper surface 684 of the piston cover that may advantageously include indicia formed therein. Such indicia may be used for advertising, particularly for brand names or logos.

Piston ring 648 is preferably formed out of an elastic sealing material, for example, rubber. Flap 640 is preferably formed out of a durable material, for example, stainless steel. Piston 610, piston valve molding 632, piston connector molding 652 and piston cover 680 are preferably formed out of a structural plastic, for example, ABS plastic.

Figure 6:
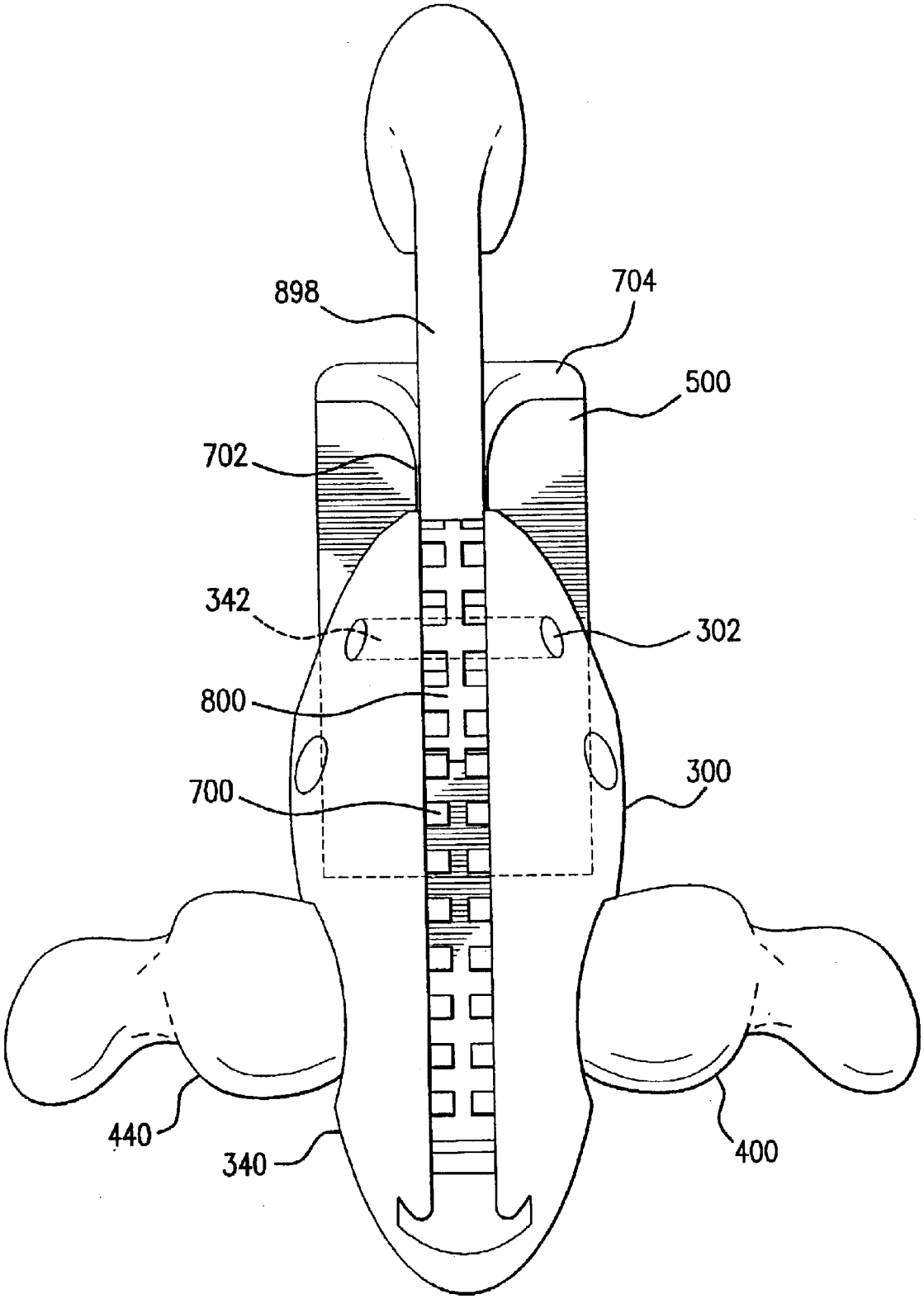
FIG. 6 is a front view of the machine of FIG. 1.

FIG. 6 is a front view of machine 200. FIG. 6 shows right and left grasps 400, 440, rack 700 and pinion 800 that is pivotally attached by pinion axle 802 that is installed through access apertures 302 and 342. Rack 700 extends beyond the pinion in both directions and is connected to lift 704 by rack connector 702. Lever handle 898, fixedly attached to pinion 800, also extends above, and in FIG. 6, partially obscures rack connector 702. Cylinder 500 is fixedly attached by right and left ears 310, 350 to right and left body halves 300, 340. In FIG. 6, a portion of cylinder 500 is obscured by body halves 300, 340.

Figure 7:
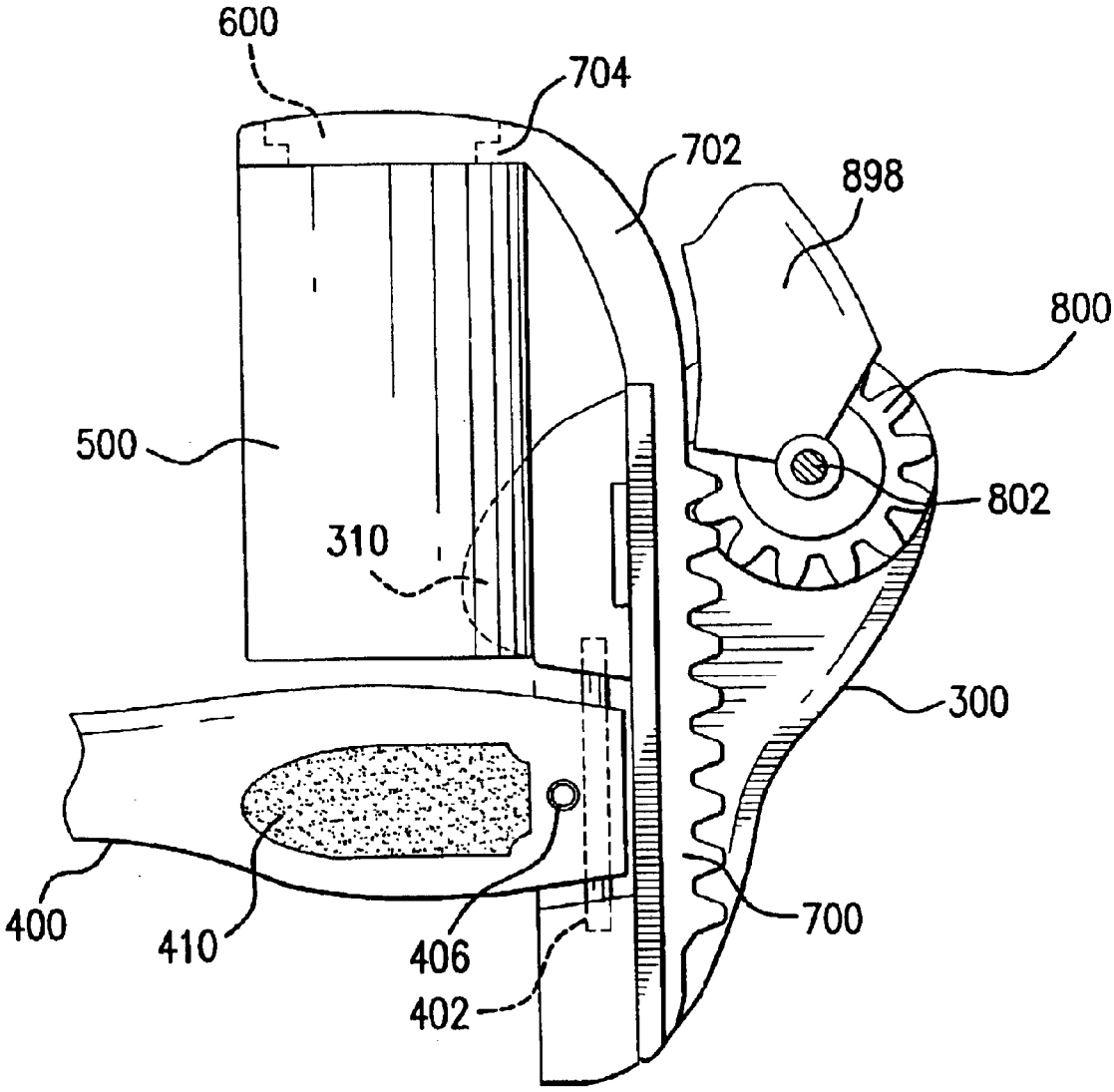
FIG. 7 is a cut away side view of the machine of FIG. 1.

FIG. 7 is a cut away side view of machine 200. Pinion 800 is geared through gear teeth to rack 700. Rack 700 is connected to lift 704 by rack connector 702, and lift 704 is connected to piston assembly 600. In operation, lifting or lowering pinion lever handle 898 causes pinion 800 to rotate around pinion axle 802 while rack 700 translates so as to lift or lower piston assembly 600 within cylinder 500. Cylinder 500 is cemented to, or otherwise fixedly attached to, right body ear 310 of right body half 300 as depicted in FIG. 7 (and to left body ear 310 of left body half 340, not shown). Pinion 800 pivots on pinion axle 802 which is fixedly attached to the body. In addition, right grasp 400 is pivotally connected to the body by right grasp axle 402. Grasp spring receiver 406 is formed in right grasp 400 for receiving the right grasp spring. Right grasp 400 includes right resilient pad 410.

Figure 8:
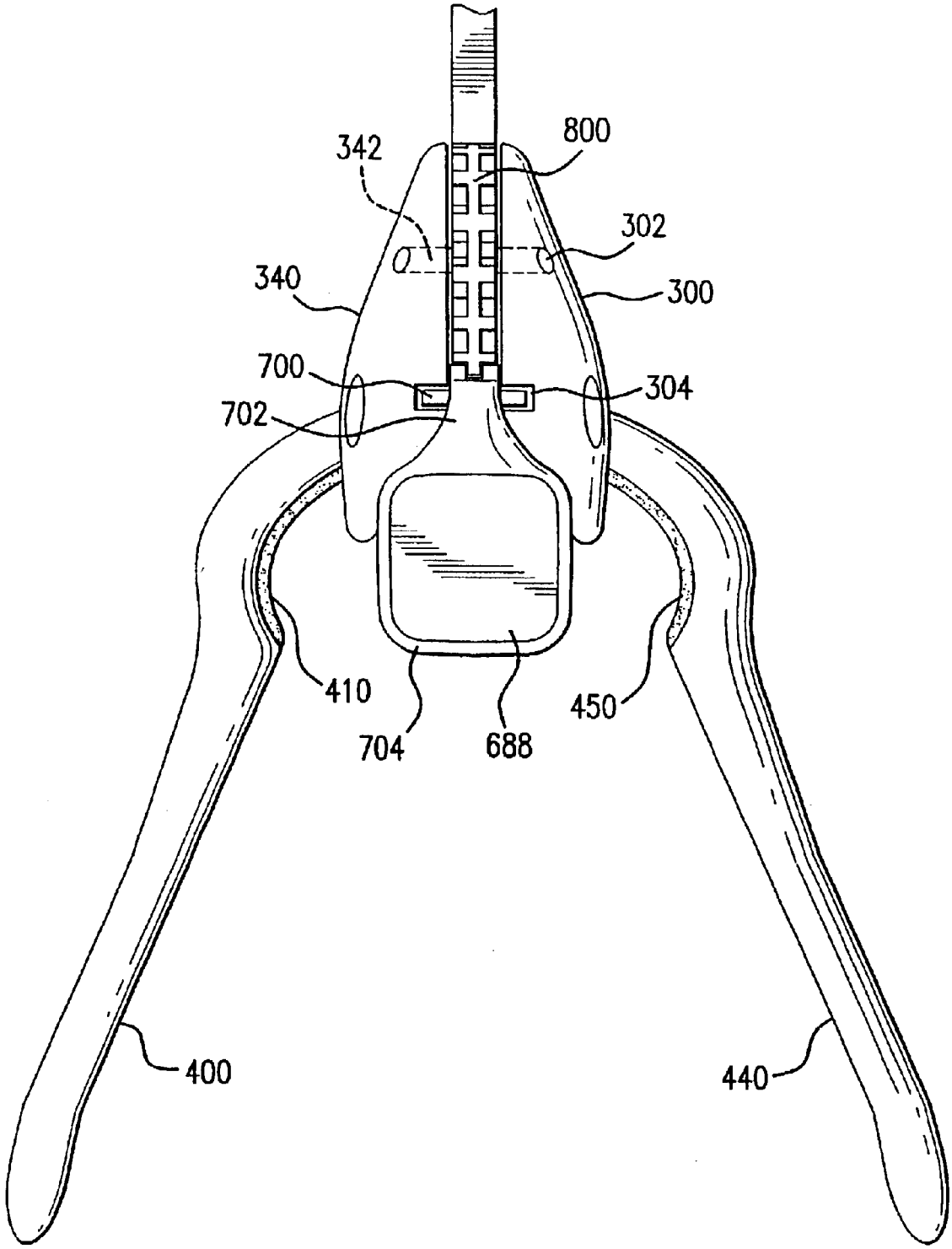
FIG. 8 is a top view of the machine of FIG. 1.

FIG. 8 is a top view of machine 200. FIG. 8 shows right and left grasps 400, 440, right and left resilient pads 410, 450, right and left body halves 300, 340 and access apertures 302, 342 through which pinion axle 802 is installed into pinion 800. Rack 700 slidably travels in rack slot 304 formed within the body. Rack connector 702 connects the rack 700 to lift ring 704 that lifts the piston assembly 600 but only upper surface 688 of the piston cover molding (without indicia) is showing in FIG. 8.

Figure 9:
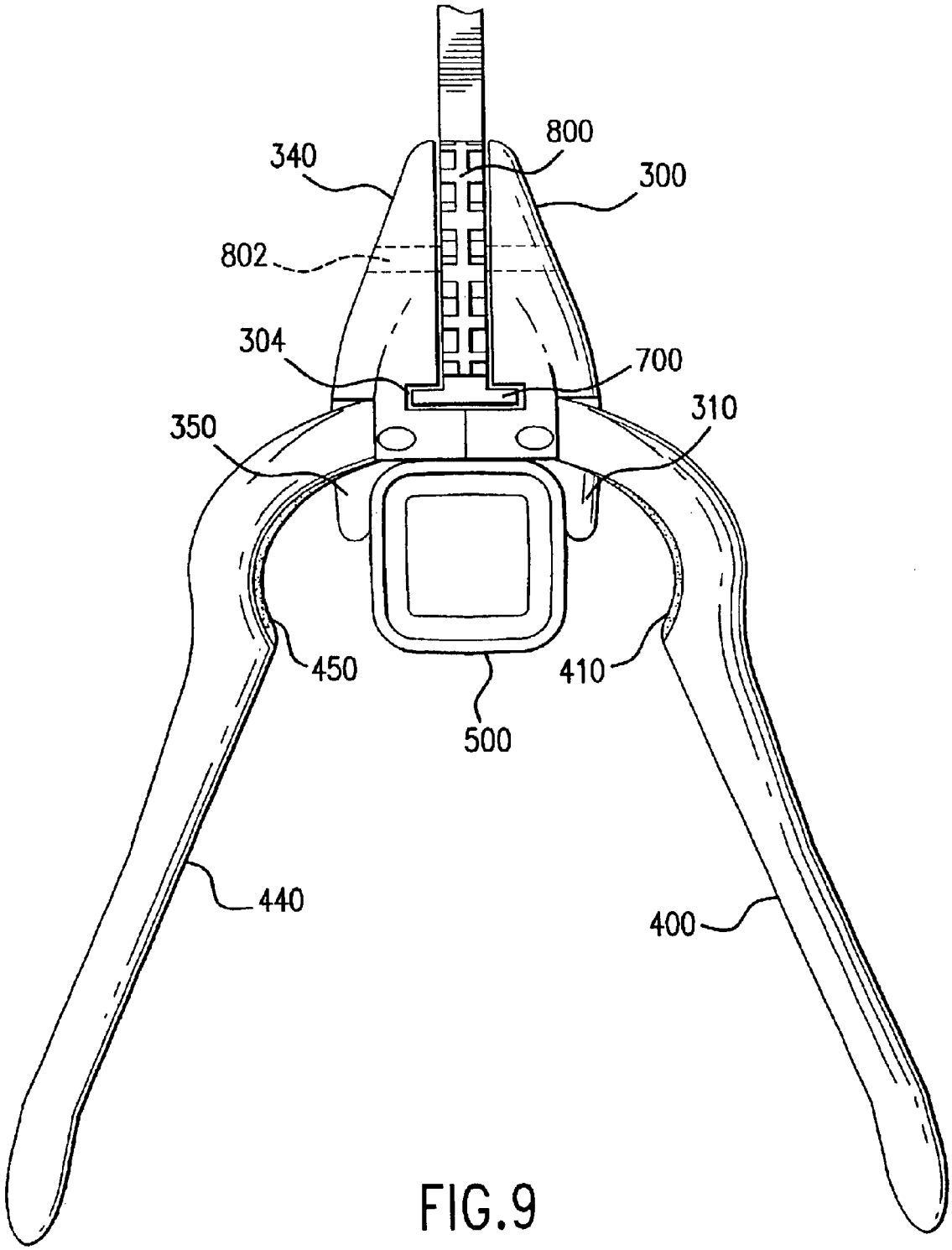
FIG. 9 is a bottom view of the machine of FIG. 1.

FIG. 9 is a bottom view of machine 200. FIG. 9 shows right and left grasp 400, 440, right and left resilient pads 410, 450, and the lower end of cylinder 500. In FIG. 9, right and left body halves 300, 340 include right and left body ears 310, 350. Cylinder 500 is cemented to, or otherwise fixedly attached to, right and left body ears 310, 350. In FIG. 9, rack 700 slidably travels in rack slot 304 in the body. Pinion 800 pivots on pinion axle 802.

Figure 10:
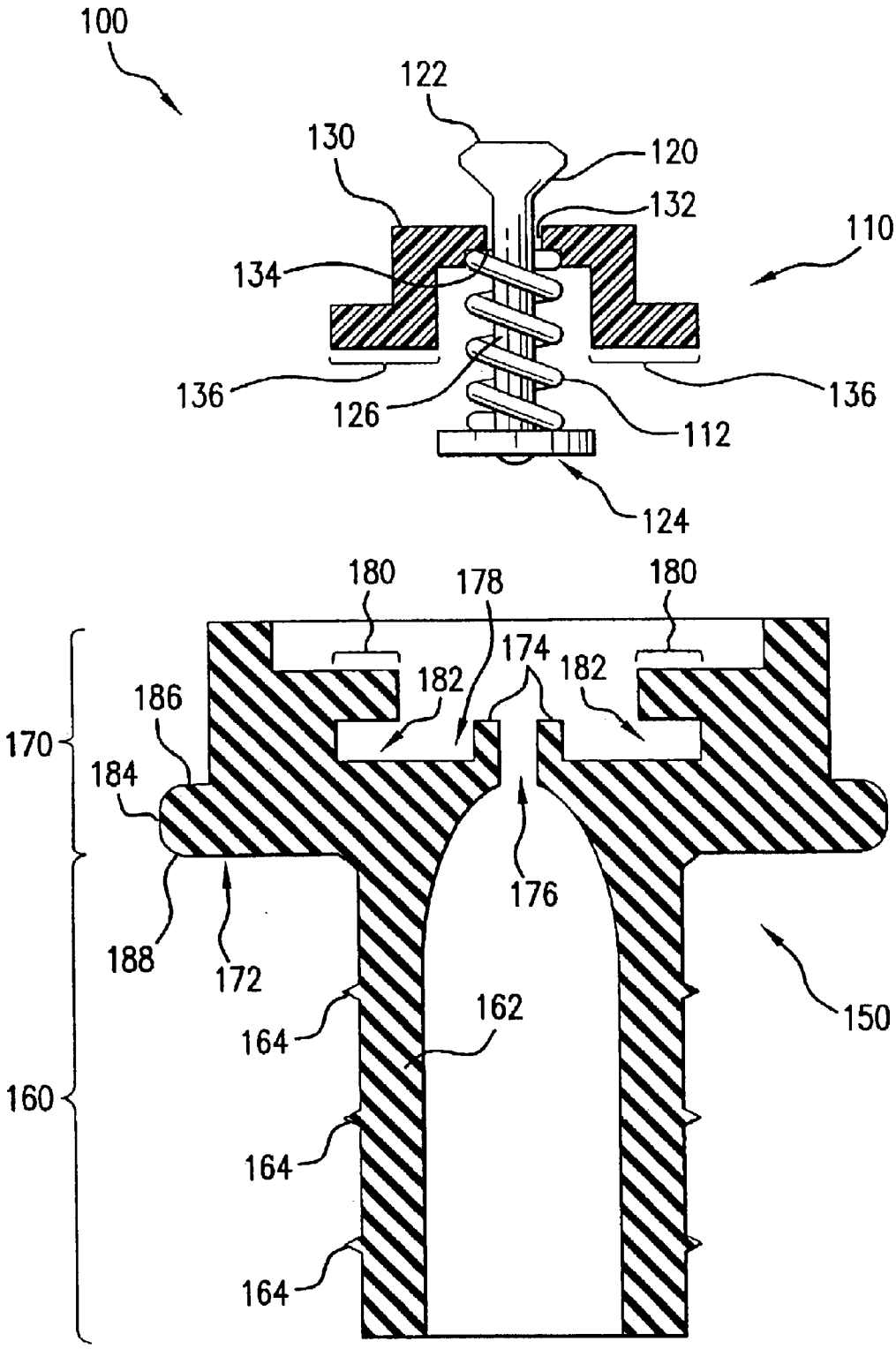
FIG. 10 is an exploded section view of a stopper assembly according to the present invention.

FIG. 10 is an exploded section view of stopper assembly 100. Stopper assembly 100 includes stopper 150 and valve assembly 110. Valve assembly 110 includes spring 112, valve 120 and valve frame 130. Valve frame 130 includes flange 136 extending around a perimeter of the valve frame and has aperture 132 extending through the valve frame. Formed into an underside portion of the valve frame is spring receiver 134. Valve 120 includes valve keeper 122, valve end 124 and valve stem 126.

In an exemplary embodiment, valve 120 is formed of ABS, or other type of, thermoformed plastic and the valve 120 begins as a valve keeper 122 (e.g., an enlarged end) formed on a long valve stem. The long valve stem is inserted through valve frame aperture 132 and through spring 112. The spring is compressed and the long valve stem is thermally formed (e.g., by upset) into valve end 124 and valve stem 126. Spring 112 and valve 120 cannot then be removed from valve frame 130 without destroying valve 120.

Stopper 150 is an integrally formed molding of a resilient material such as rubber. The molding includes lower portion 160 and upper portion 170. Lower portion 160 includes lower portion wall 162 and a plurality of rings or ribs 164 formed on the wall. The lower portion is inserted into the inside of the neck of a wine bottle and the rings 164 seal the stopper 150 tightly to the neck of the wine bottle.

The upper portion 170 has integrally formed therewith a valve seat 174 having aperture 176 extending through the valve seat. The upper portion also has integrally formed therewith a lip 180 so as to define recess 182 in a perimeter of cavity 178. Stopper 150 is sufficiently elastic that lip 180 can be stretched to allow flange 136 of valve assembly 110 to be inserted into recess 182 and held in place by lip 180 to form stopper assembly 100. The upper portion also has integrally formed therewith a ledge 184 having an upper surface 186 and a lower surface 188.

Figure 11:
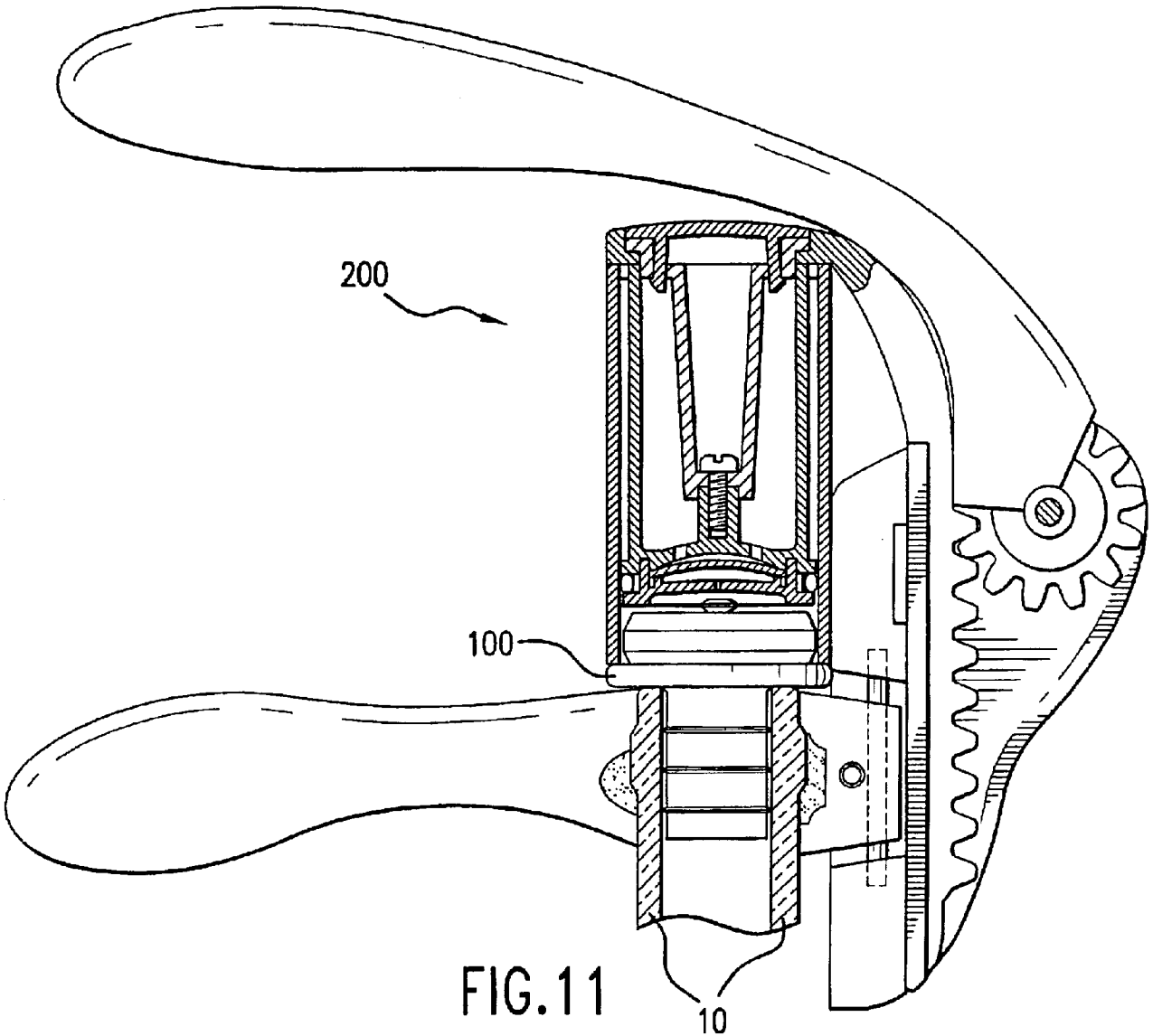
FIG. 11 is a section view of the machine depicted as positioned on the neck of a bottle.

FIG. 11 shows a wine bottle neck 10 into which stopper assembly 100 has been inserted and a cut away section view of machine 200 positioned on the stopper assembly. In operation, stopper assembly 100 is inserted into the neck 10 of a wine bottle, preferably until the lower surface 188 of ledge 184 of stopper 150 (see FIG. 10) seats on an upper surface of the neck 10 of the wine bottle. Then, the sealing end of cylinder 500 of the pump machine is installed on the stopper 150, preferably with the sealing end of cylinder 500 pressing against and sealing to upper surface 186 of ledge 184 of stopper 150. Spring 112 urges valve end 124 against valve seat 174 to form a tight seal, and a sealing end of pump cylinder 500 seals against the upper surface 186 of ledge 184 of stopper 150. When pump lever handle 898 is raised, pinion 800 rotates, rack 700 and lift 704 is raised, and the whole piston assembly 600 is raised so as to form a vacuum in the chamber beneath pump valve 630. Gases within the wine bottle pass through aperture 176 and press against the lower side of valve end 124 with sufficient force to overcome spring 112. Valve 120 is raised under the influence of this gas pressure, and the gas within the bottle passes through aperture 176, around valve end 124, through aperture 132 into the vacuum in cylinder 500 beneath piston valve 630. Then, when pump lever 898 is lowered, the gas beneath piston valve 630 is slightly compressed so that valve end 124 again urges against and seals to valve seat 174 to block gas from being forced back into the bottle. At the same time, the slightly compressed gas beneath valve seat 630 passes through aperture 634, around flap 640 and then through one or more apertures 616. When pump lever handle 898 is again raised, a vacuum is again drawn by the pump in the chamber beneath piston valve 630. Flap flange 642 presses against and seals to flap seat 644, and gases within piston 610 pass through vents 613 of piston side wall 612 (see FIG. 2).

Having described preferred embodiments of a novel wine saving machine (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as defined by the appended claims.

Having thus described the invention with the details and particularity required by the patent laws, what is claimed and desired protected by Letters Patent is set forth in the appended claims.

What is claimed is:

1. A machine comprising:

a body;

a hollow cylinder fixedly attached to the body and having a sealing end;

a piston assembly slidable within the hollow cylinder, the piston assembly including a cross wall at a first end having an aperture formed therein;

a lever handle pivotally attached to the body and coupled to the piston assembly so as to be capable of sliding the piston assembly in the hollow cylinder; a flap; and a molding, wherein the molding is affixed to the cross wall so as to cage the flap.

2. A machine comprising:

a body;

a hollow cylinder fixedly attached to the body and having a sealing end;

a piston assembly slidable within the hollow cylinder, the piston assembly including a cross wall at a first end;

a lever handle pivotally attached to the body and coupled to the piston assembly so as to be capable of sliding the piston assembly in the hollow cylinder;

a pinion fixedly attached to the lever handle and pivotally attached to the body so as to be rotationally responsive to a radial movement of the lever handle; and a rack slidable with respect to the body and translationally responsive to a rotation of the pinion so as to slide the piston assembly within the hollow cylinder.

3. The machine of claim 2, further comprising at least first and second grasps, wherein:

the first grasp is pivotally attached to the body; and the second grasp is pivotally attached to the body.

4. The machine of claim 3, wherein:

the first grasp is capable of being pivoted about a first axis;

the second grasp is capable of being pivoted about a second axis, the first and second axes being parallel and spaced apart; and the pinion is capable of being rotated about a third axis, the third axis being non-parallel to and non-intersecting with the first axis.

5. A machine comprising:

a body;

a hollow cylinder fixedly attached to the body and having a sealing end;

a piston assembly slidable within the hollow cylinder, the piston assembly including a cross wall at a first end;

a lever handle pivotally attached to the body and coupled to the piston assembly so as to be capable of sliding the piston assembly in the hollow cylinder; and at least first and second grasps, wherein the first grasp is pivotally attached to the body and the second grasp is pivotally attached to the body.

6. The machine of claim 5, wherein:

the first grasp is capable of being pivoted about a first axis; and the second grasp is capable of being pivoted about a second axis, the first and second axes being parallel and spaced apart.

7. The machine of claim 1, further comprising a stopper assembly, wherein the stopper assembly includes:

a valve assembly; and a stopper.

8. The machine of claim 7, wherein the valve assembly includes:

a valve frame having an aperture through the valve frame;

a spring; and a valve extending through the spring and through the aperture.

9. The machine of claim 8, wherein:

the valve frame includes a flange; and the stopper includes a lip defining a recess into which the flange is inserted.

10. A method of using the machine of claim 1 comprising:

inserting a stopper assembly in a neck of a bottle that contains wine;

installing the machine onto the stopper assembly;

drawing a gas from the bottle through a valve assembly of the stopper assembly into a chamber between a piston valve of the machine and the stopper assembly by producing a vacuum in the chamber; and expelling the gas in the chamber through the piston valve by closing the valve assembly and reducing a volume of the chamber.

11. The method of claim 10, further comprising repeating the drawing of the gas from the bottle and the expelling of the gas from the chamber.

12. The method of claim 10, further comprising grasping the neck between two grasps pivotally attached to the body.

13. The method of claim 10, wherein:

the drawing of the gas from the bottle includes rotating the lever handle to expand the volume of the chamber; and the expelling of the gas in the chamber includes rotating the lever handle to reduce the volume of the chamber.

14. The method of claim 13, further comprising grasping the neck between two grasps pivotally attached to the body.

* * * * *